United States Patent [19]

Swisher, Jr. et al.

[11] 4,221,434

[45] Sep. 9, 1980

[54] ROADWAY BREAKER PLATE FOR A PLANAR APPARATUS

[75] Inventors: George W. Swisher, Jr., Oklahoma City; John F. Phillips, Yukon, both of Okla.

[73] Assignee: CMI Corporation, Oklahoma City, Okla.

[21] Appl. No.: 889,244

[22] Filed: Mar. 23, 1978

[51] Int. Cl.[2] ..... E01C 23/09

[52] U.S. Cl. ..... 299/39; 241/237; 404/90

[58] Field of Search ..... 299/39, 41, 36, 37, 299/40, 85, 86; 404/90, 91; 241/237; 125/9; 172/39, 63, 66

[56] References Cited

U.S. PATENT DOCUMENTS

| | | | |
|---|---|---|---|
| 1,390,089 | 9/1921 | Cook | 172/39 X |
| 2,009,500 | 7/1935 | Kramer | 299/39 X |
| 2,357,374 | 9/1944 | Ariens | 404/90 |
| 2,788,725 | 4/1957 | Wilkey et al. | 172/39 X |
| 3,732,023 | 5/1973 | Rank et al. | 404/90 |
| 3,991,830 | 11/1976 | Shepherd | 299/40 X |

FOREIGN PATENT DOCUMENTS

| | | | |
|---|---|---|---|
| 2160403 | 10/1977 | Fed. Rep. of Germany | 404/90 |
| 813989 | 6/1937 | France | 404/90 |

*Primary Examiner*—Ernest R. Purser
*Attorney, Agent, or Firm*—Dunlap, Codding & McCarthy

[57] ABSTRACT

A roadway breaker plate for a planer apparatus having a drum type planer cutter for removing the top portion of an existing roadway, the breaker plate providing a counteracting shearing force on the top portion of the roadway at a predetermined distance from the planer cutter whereby the top portion of the roadway removed by the planer cutter is removed in the form of cuttings generally of a uniform size.

22 Claims, 5 Drawing Figures

ROADWAY BREAKER PLATE FOR A PLANAR APPARATUS

BACKGROUND OF THE INVENTION

1. Field of the Invention

The present invention relates generally to the field of road construction apparatus and, more particularly, but not by way of limitation, to road construction apparatus using a planar apparatus for removing a top portion of an existing roadway.

2. Description of the Prior Art

In the repair and maintenance of paved roads, a planar apparatus of the type described in the related U.S. patent application Ser. No. 672,326, entitled "A Method and Apparatus for Planing a Paved Roadway", assigned to the assignee of the present invention, is finding increasing usage. A planar apparatus of this type comprises a rotating drum planer cutter having cutting teeth which are disposed to engage the top portion of an existing roadway as the planar cutter is caused to move therealong. Not only has this planar apparatus afforded a means for effecting a new surface that has a predetermined grade and cross-slope, the material that is removed from the roadway is reusable as a part of newly prepared hotmix asphalt that is used to form a new roadway layer on top of the new surface created by the planer apparatus.

It has been found that the use of a planer apparatus of the type mentioned often results in cuttings that are not uniform or predictable in size for the reason that the planer apparatus often tends to remove the top portion of the roadway in large chunks, especially near the upper surface thereof. In order to meet the requirement of size and uniformity required of aggregate used to form new hotmix asphalt, the removed cuttings must be broken apart by appropriate means and graded before being recycled as a constituent portion of new paving material.

Not only must energy be expended to size the cuttings, but the cuttings must be collected and passed through a sizing and grading operation after the planing operation, which represents a loss of economy as this is an additional material handling step. It would be desirable if the cuttings could be removed from the roadway having an acceptable particulate size range. In this form, the cuttings could be conveyed directly to a hotmix asphalt mixing machine or the like, melted down and mixed with new paving material, and deposited on the newly created surface to form a new roadway surface. In this way, the removed roadway material would be recycled directly, eliminating additional sizing and grading operations, and combined in a predetermined mixture with new roadway paving material. Further, this would permit the lay down of the new roadway layer by machinery that follows immediately behind the planer apparatus.

SUMMARY OF THE PRESENT INVENTION

The present invention provides a roadway breaker plate in combination with a planer apparatus having a drum type planer cutter rotatable about a longitudinal axis and supportable over an existing paved roadway wherein cutting teeth disposed about the planer cutter cuttingly engage the roadway for removing a predetermined top portion of the roadway. The breaker plate is disposed a predetermined distance forward of the planar cutter and exerts a counteracting shearing force on the roadway forward of the planer cutter whereby the cuttings generated by the cutting teeth are caused to be formed of a generally uniform size.

Accordingly, it is an object of the present invention to provide a roadway breaker plate to be utilized in combination with a rotatable drum planer apparatus for removing the top portion of an existing roadway in the form of cuttings having a generally uniform size.

Another object of the present invention is to provide a roadway breaker plate disposable a predetermined distance forward of a planer cutter which is generally not affected by the cross-slope of a roadway being planed and whereby the predetermined uniform size range of the cuttings is continuously maintained.

Another object of the present invention is to provide a roadway breaker plate for use with a planer apparatus that will facilitate removal of the top portion of an asphalt roadway in the form of cuttings which can be recycled without further processing prior to use as a portion of new hotmix asphalt paving material.

Another object of the present invention is to provide a roadway breaker plate apparatus which can easily and economically be constructed of conventional materials, and which can be easily operated and maintained.

Other objects, advantages and features of the present invention will be apparent from the following detailed description when read in conjunction with the accompanying drawings which illustrate presently preferred embodiments of the invention, along with the appended claims.

DESCRIPTION OF THE EMBODIMENT OF FIGS. 1 THROUGH 3

Figure 1:
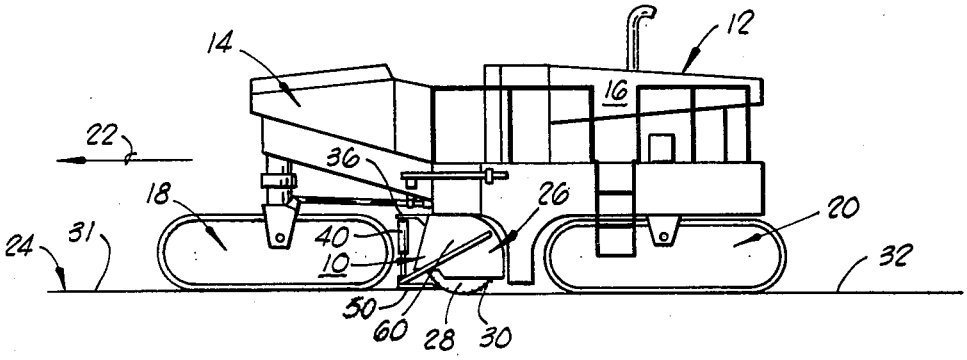
FIG. 1 is a diagrammatical representation in side elevational view of a roadway plate shown in combination with a road planer apparatus generally illustrating the present invention.
Figure 2:
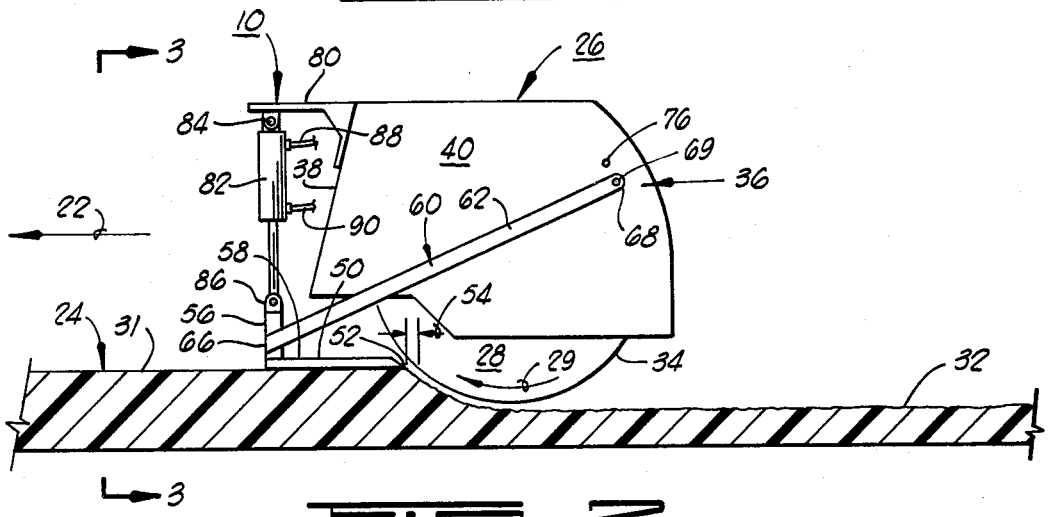
FIG. 2 is a side elevational view of one embodiment of the roadway breaker plate presented by the present invention.

Referring to the figures in general, and to FIGS. 1 and 2 in particular, shown therein and designated via the general reference numeral 10, is a roadway breaker plate assembly constructed in accordance with the present invention. The breaker plate assembly 10 is generally utilized in combination with a planar apparatus 12 which is shown in semi-detailed, diagrammatical representation in FIG. 1.

The planer assembly 12 generally comprises a frame 14 that supports a power unit 16, and a front track assembly 18 and a rear track assembly 20 in turn support the frame 14. The power unit 16 and the track assemblies 18, 20 are of conventional design and cooperate with components not shown or described to move the planer assembly 12 in a forward direction 22 along an existing roadway 24.

Supported by the frame 14 and disposed therebeneath to cuttingly engage a top portion of the roadway 24 is a planer cutter assembly 26 that comprises a cylindrically shaped drum 28 that is rotatable in the direction 29 about its longitudinal axis that passes through its center. Disposed about the drum 28 are a plurality of cutters 30 that are the members that cuttingly engage the top portion of the roadway 24 as the drum 28 is rotated by means not shown, and as the planer assembly 12 is caused to move in the forward direction 22.

For a more detailed description of a planer apparatus, reference is made to the previously mentioned U.S. patent application Ser. No. 672,326, which provides a full description of one such planer apparatus. While there are other components of the planer apparatus 12 that have not been discussed herein, the purposes of the present disclosure are served by generally providing the major components in the above manner so that attention may be directed to the breaker plate assembly 10 and its relationship to the planer cutter assembly, as will now be undertaken.

With continued reference to FIGS. 1 and 2, the planer apparatus 12 is utilized for removing a top portion 31 of an existing roadway 24, resulting in a uniform planed surface 32. The cutters 30 are chisel cutters, or the like, that are positioned in a spiral manner about the drum 28. The cutting points of the chisel cutters are uniformly positioned to cut along a cutting plane beneath the drum 28. That is, the cutting plane is substantially coincident with the planed surface 32. The chisel cutters are not shown in the accompanying drawings in order to simplify the drawings in the interest of clarity of presentation; rather, the cutting points of the cutters 30 are represented forming a cutting line 34. Also, like numbers for similar components will be used in the various drawings.

Figure 3:
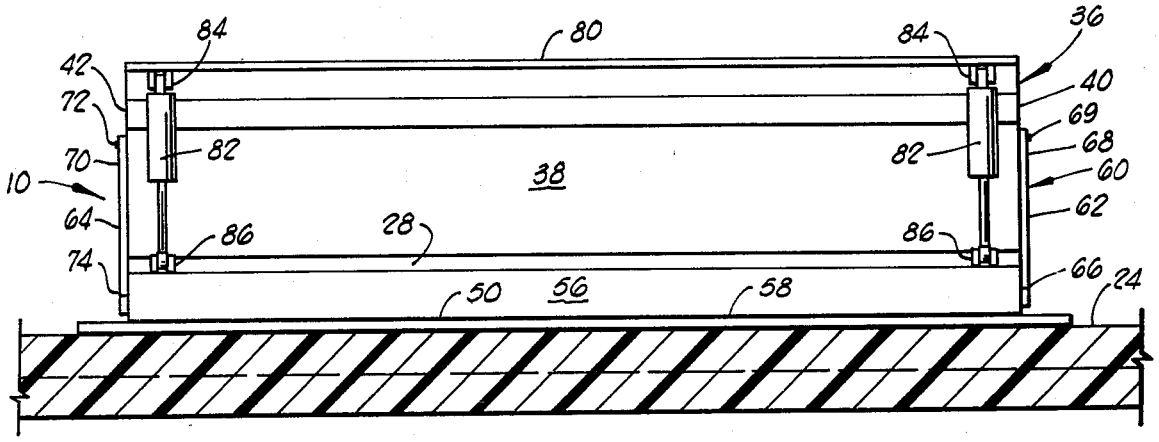
FIG. 3 is a front elevational view of the roadway breaker plate shown in FIG. 2.

Turning to FIGS. 2 and 3, a planer cover 36 is disposed over the upper portion of the drum 28, exposing only the portion of the drum 28 and cutters 30 in cutting engagement with the roadway 24. The cover 36 is secured to the frame 14, and substantially forms a supportive extension thereof. The cover 36 has a front panel 38, and opposite end panels 40 and 42, as may be viewed in FIG. 3.

During the planing operation, the top portion 31 of the roadway 24 is removed by the cutters 30 in the form of chunks or particles which will be referred to herein as cuttings. After the planed surface 32 has been formed by the planing operation, the roadway 24 may be left as is (and thus provide a road surface having uniform traction characteristic); or a new bituminous layer (not shown) may be deposited on the planed surface 32, in which case it would be desirable to reuse the cuttings removed via the planing operation as a constituent portion of the new bituminous layer deposited on the planed surface 32.

When such cuttings are recycled, they are generally mixed in a predetermined proportion with a quantity of new paving material. The asphaltic content of the cuttings reduce the quantity of new bitumen that must be added, and the cuttings are utilized in place of some of the aggregate that would normally comprise a portion of the new paving material. For this reason, the cuttings should be of a generally uniform size and gradation in order to insure a proper mixture.

It has been found that as the cutters 30 cut into the top portion 31 of the roadway 24, some of the cuttings tend to break away from the roadway 24 in the form of undesirably large chunks or particles. Since it is desired that these cuttings be of a predetermined size and generally uniform within a selected size range, these undesirably large cuttings must first be broken up and graded before being melted down and mixed with new roadway paving material.

As will become clear with the following description, the breaker plate assembly 10 provides a means for providing a downward shearing force on the top portion of the roadway 24 at a predetermined distance forward of the planer cutter 26, effecting the removal of the top portion 31 of the roadway 24 in the form of cuttings having a generally uniform predetermined size. The size of the cuttings is generally a function of the distance between the shearing portion of the assembly 10 and the planer cutting line 34. This distance is normally maintained at approximately one to two inches, and provides cuttings of approximately three-fourths to one and one-half inches in diameter, but the distance may be decreased for finer cuttings, or increased for larger cuttings.

The embodiment of the breaker plate assembly 10 shown in FIGS. 2 and 3 is generally utilized when planing a roadway having a substantially level cross-slope, as best shown in FIG. 3. That is, a roadway having a substantially level cross-slope with relatively little crown or lateral slope.

The breaker plate assembly 10 is constructed to have a breaker plate 50 that is a rigid member with a shearing edge 52 extending laterally beneath the frame 14 a selectable distance 54 forward of the cutting line 34 of the planer cutter 26. That is, the clearance between the shearing edge 52 is the distance 54. The breaker plate 50 is stiffened by a stiff-back member 56 that is attached to the upper surface 58 of the breaker plate 50 and extends substantially the length of the plate 50.

The breaker plate 50 is preferably constructed of a rigid material such as hardened steel, or the like, and may be in the form of a conventional grader blade. The stiffback member 56, preferably a rigid length of flat bar stock, is securely attached to the breaker plate 50 such as by welding or the like.

A positioning assembly 60 is provided for maintaining the shearing edge 52 a predetermined distance 54 forward of the planer cutter 26, and includes a first pivot arm 62 connected between one end portion of the breaker plate 50 and the end panel 40 of the planer cover 36, and a second pivot arm 64 similarly connected between the opposite end portion of the breaker plate 50 and the other end panel 42 of the planer cover 36. One end portion 66 of the first pivot arm 62 is attached to one end of the stiff-back member 56 such as by welding, and the opposite end portion 68 of the first pivot arm 62 is pivotally connected to the end panel 40 at a pivot point 69. In like manner, one end 70 of the second pivot arm 64 is pivotally connected to the end panel 42 at a pivot point 72 and the other end 74 is secured to the stiff-back member 56.

The distance 54 between the shearing edge 52 and the cutting line 34 for a given depth of cut of the planer cutter is determined by the pivot points at which the first and second pivot arms 62, 64 are connected to the planer cover 36. That is, the distance 54 may be varied by selecting different pivot points on the planer cover 36. For example, if the first pivot arm 62 is pivotally connected to the end panel 40 at a different pivot point 76 (and in like manner, the second pivot arm 64 is pivotally connected to the end plate 42 at a similarly displaced pivot point that is not shown), it will be clear that the distance 54 will be altered. Several such pivot points may be provided to afford a range of values from which the distance 54 may be determined by selecting appropriate pivot connecting points on the end panels 40, 42 as desired.

It will also be apparent that the arc circumscribed by the edge 52 will be a function of the length of the pivot arms 62, 64. Since this arc is not concentric with the cutting line 34, (unless the pivot points 69, 72 are positioned on the axis of the drum 28, which is one of many variants within the scope of the present invention) stop members may be provided to limit the travel of the pivot arms 62, 64 so as to prevent inadvertent contact by the breaker plate 50 with the cutters 30.

The breaker plate assembly 10 further comprises a support element 80 that is connected to an upper portion of the planer cover 36 on the front panel 38. A pair of conventional hydraulic rams 82 are each connected to the support element 80 at a connector 84 and each extends generally downwardly and is pivotally connected to the stiff-back member 56 at a connector 86.

The hydraulic rams 82 are in fluid communication with a fluid control system (not shown) via conduits 88 and 90 and serve to bias the breaker plate 50 into sliding engagement with the roadway 24. That is, during the planing operation, the breaker plate 50 substantially rides upon the upper surface of the roadway 24. If the breaker plate 50 contacts a raised irregularity (not shown) on the upper surface of the roadway 24, the breaker plate 50 will have a tendency to push upwardly against the biasing action of the hydraulic rams 82. Conventional hydraulic pump and sensor means (not shown) may be employed to maintain a constant pressure on the hydraulic rams 82 as the extension of the rams is decreased. Once the raised irregularity in the roadway 24 is passed by the breaker plate 50, the rams 82 will automatically extend, maintaining the breaker plate 50 in engagement with the roadway 24 with substantially equal pressure. In like manner, the breaker plate 50 is maintained constantly in engagement with the roadway 24 when a depression is passed over by the breaker plate 50. In other words, the breaker plate 50 is yieldingly urged into contact with the top portion 31 of the roadway 24 even when the upper surface thereof is somewhat less than smooth, as is frequently the case.

It is within the scope of the present invention that other bias means such as coil springs (not shown), for example, could be used in place of the hydraulic rams 82. Coil springs would allow the breaker plate 50 to spontaneously conform to an irregular top surface of a roadway, would be substantially maintenance free, and would require no pressure control system. However, it is believed that a greater flexibility and more uniform pressure will be maintained using the hydraulic rams 82, as described above. It is suggested that coil springs might be used when planing a roadway having a substantially level cross-slope and a generally regular top surface, with the hydraulic rams 82 being used on a roadway having a high crown and a very irregular, or pitted top surface, for example.

In operation, the cutters 30 are caused to engage the roadway 24 as the drum 28 is rotated in the direction 29. As the cutters 30 pass the shearing edge 52, the cuttings are caused to be sized no larger than the clearance distance 54. Furthermore, the pressure exerted on the upper portion 31 during the cutting prevents the tearing away of larger pieces at the top thereof. Consequently, the cuttings removed by the cooperative efforts of the breaker plate assembly 10 and the planer cutter assembly 26 are more uniform and may be added directly to new bituminous material to form hotmix asphalt.

DESCRIPTION OF THE EMBODIMENT OF FIGS. 4 AND 5.

It will be recognized in the above described embodiment that the clearance distance 54 between the shearing edge and the cutting line 34 will vary with the horizontal placement of the breaker plate 50 (except for the case in which the pivot points 69, 72 of the pivot arms 62, 64 are positioned on the axis of the drum 28). A variation in the clearance distance results in a variation in the size of cuttings removed. Accordingly, it would be desirable to support the breaker plate assembly independently of the axis of the drum and yet maintain a predetermined constant value of the clearance distance as the breaker plate is pivotally displaced during the operation of the planer apparatus.

Figure 4:
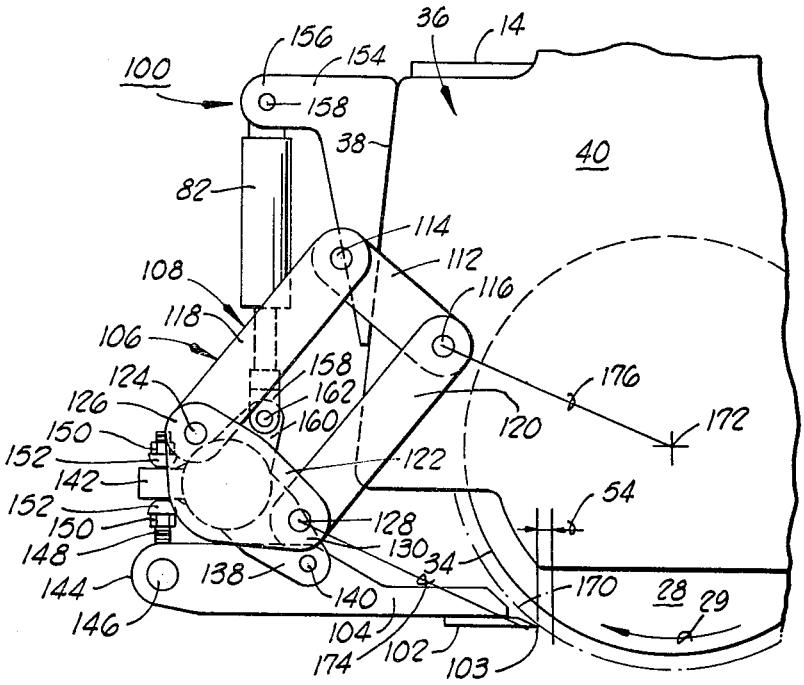
FIG. 4 is a side elevational view of another embodiment of a roadway breaker plate presented by the present invention.
Figure 5:
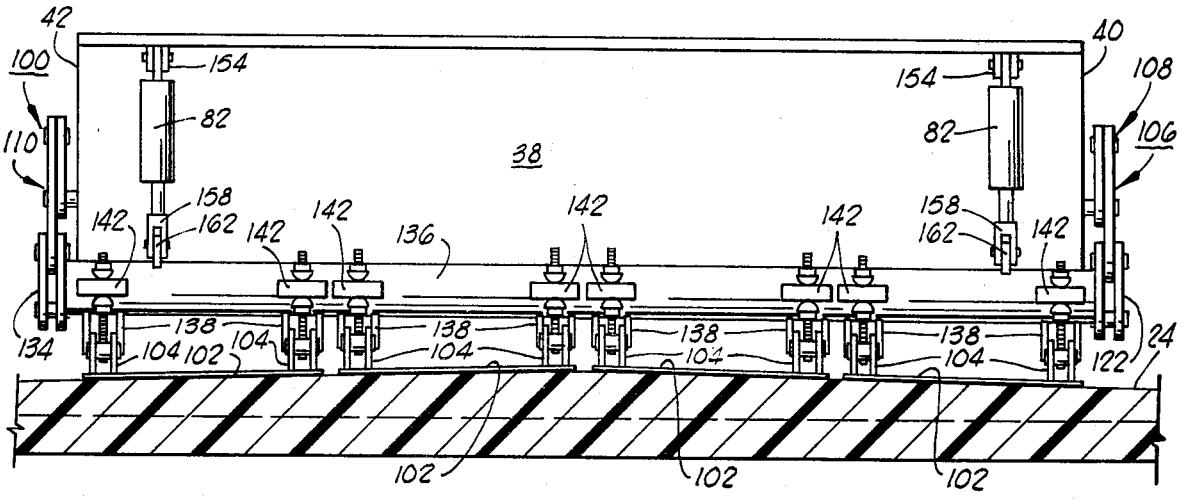
FIG. 5 is a front elevational view of the roadway breaker plate shown in FIG. 4.

The embodiment of the present invention shown in FIGS. 4 and 5 is designed to support the breaker plate a predetermined distance from the cutting line of the planer cutter while permitting the vertical displacement of the breaker plate. Insofar as is clear, like numerals to those used in FIGS. 1 through 3 will be used in FIGS. 4 and 5 to identify like components.

Referring to FIGS. 4 and 5, shown therein is a breaker plate assembly 100 that comprises a plurality of breaker plates 102 having a shearing edge 103, and each of which is attached to two spaced apart breaker plate support arms 104. A breaker plate support assembly 106 is supported by the planer cover 36 (or it may be attached directly to the frame 14) and several breaker plates 102 are connected to the breaker plate support assembly in the manner to be made clear below.

As noted by referring to FIG. 5, which shows a semi-detailed front view of the breaker plate assembly 100, the invention is illustrated using four breaker plates 102. This is an arbitrary assignment of the number of such breaker plates, as any number could be used. The purpose of using several breaker plates is to accommodate the crown of the roadway 24 that exists laterally to the direction of travel 22 of the planer apparatus 12.

The breaker plate support assembly 106 comprises a first parallelogram assembly 108 supported by the end panel 40 and a second parallelogram assembly 110 supported by the end panel 42. Since the first and second parallelogram assemblies 108, 110 are substantially identical in construction details, it will be sufficient to describe the first parallelogram assembly 108 herein. The first parallelogram assembly 108 comprises a support arm 112 that is connected to the end panel 40 by any convenient manner such as by welding. A first pivot pin 114 and a second pivot pin 116 are attached to the support arm 112. A first parallel arm 118 with an appropriately sized aperture therein is pivotally connected to the support arm 112 via the first pivot pin 114, and a second parallel arm 120 with an appropriately sized aperture therein is pivotally connected to the support arm 112 via the second pivot pin 116, as shown.

A first end plate member 122 is pivotally connected to the distil ends of the first and second parallel arms 116, 118 via appropriately sized apertures and pivoting pins as follows. A third pivot pin 124 is attached to the distil end of the first parallel arm 118 and is pivotally disposed in an aperture in an ear portion 126 of the first end plate member 122. In like manner, a fourth pivot pin 128 is attached to the distil end of the second parallel arm 120 and is pivotally disposed in an aperture in an ear portion 130 of the first end plate member 122.

It will be recognized that this arrangement permits the pivotation of the first and second parallel arms 118, 120 and the first end plate member 122 relative to the stationary support arm 112, forming a conventional parallelogram linkage. The similarly constructed second parallelogram assembly 110 is supported by the end panel 42 at the other side of the planer apparatus 12, as shown in FIG. 5. A second end plate member 134, similar to the first end plate member 122, comprises a portion of the second parallelogram assembly 110 and is pivotally supported by a pair of parallel arms that are pivotally supported by a support arm that is secured to the end panel 42. This arrangement also forms a conventional parallelogram linkage.

A rigid support beam 136 is supported between and securely attached to the first end plate member 122 and the second end plate member 134. The support beam 136 serves to support all of the breaker plates 102 in the following manner. Disposed at spaced apart positions along the support beam 136 are a plurality of paired link members 138 that extend generally downwardly to be disposed adjacent to each side of each one of the breaker plate support arms 104. Axially aligned apertures are disposed in the link members 138 and the breaker plate support arms 104, and a connecting pin 140 is disposed in the apertures so as to pivotally connect each one of the breaker plate support arms 104 to the support beam 136.

Extending generally forwardly and attached at spaced apart positions along the support beam 136 are a plurality of apertured lug members 142. The end 144 of each one of the breaker plate support arms 104 is bifurcated so as to form a yoke connector member having axially aligned apertures in which is disposed a pin 146. Attached to each one of the pins 146 is an all thread stud member 148 that is sized to extend generally upwardly and through the aperture of a corresponding lug member 142. Appropriately sized nut members 150 and washer members 152 are disposed on the stud members 148 on each side of the respective lug member 142 to secure the end 144 of the breaker plate support arm 104 in the manner shown in FIG. 4; the distance that the end 144 is positioned relative to its respective lug member 142 is adjustable by selectively positioning the nut members 150 along the stud member 148.

To bias the breaker plates 102 against the roadway 24 in the manner and for the purpose described hereinabove for the breaker plate assembly 10, the pair of hydraulic rams 82 are attached to one end of a pair to support arms 154 that are attached to the end panel 38 of the planer cover 36. Each of the support arms 154 has an extending clevis end 156 that has axially aligned apertures through which a pin 158 is disposed, the pin 158 also passing through an aperture in the end of one of the rams 82. The extending rod end 158 of each of the rams 82 is shaped in the form of a clevis and is connected to the support beam 136 with a lever arm member 160, that extends from the support beam 136, via a connecting pin 162.

It will be recognized that an extension or contraction of the rams 82 would cause a rotational displacement of the support beam 136 via the lever arm member 160, and consequently, a resulting rotational displacement of the lug members 142 that are connected via the stud members 140 to the breaker plate support arms 104. Conversely, this relative movement is followed in the operation of the planer apparatus 12 as a varying force is exerted on the breaker plates 102 (effected by variations in the surface of the roadway 24). Again, the rams 82 are connected via conduits (not shown) to a conventional hydraulic system to maintain constant pressure on the rams independently of the extension or contraction thereof.

As shown in FIG. 5, the multiple-sectioned breaker plate more closely conforms to the cross slope of the roadway 24. By properly adjusting the two stud members 148 that are connected to each one of the breaker plates 102, the breaker plates 102 serve as segments of a breaker plate assembly that is conformable to the degree of slope at various positions along the surface of the roadway 24.

The function of the breaker plates 102 is to apply a back up or countering shearing force to the force exerted on the roadway 24 by the cutters 30 on the drum 28, and the operation thereof in performing this function is the same as that which has been described hereinabove for the breaker plate 50, with the exception that the breaker plates 102 are positioned at a constant clearance distance from the cutting line 34. That is, the shearing edge 103 will circumscribe an arc 170 which is on a circle that is concentric with the center 172 of the cutter line circle 34 shown in FIG. 4. The difference between the radius of arc 170 and the radius of the cutter line circle 34 is the clearance distance 54 between the shearing edge 103 and the cutters 30, and it will be clear that once the position of the pivot point 116 is established, the distance 54 will be established by the length selected for the first and second parallel arms 118, 120. It will also be evident that the distance 174 from the shearing edge 102 and the pivot 128 of the first parallelogram assembly 108 will remain fixed regardless of the position that the breaker plate 102 assumes (disregarding the small effect of the adjustment of the stud members 148). Also the distance 176 from the center 172 of the arc 170 to the pivot 116 is fixed. Therefore, as long as the displacement distances 174 and 176 are of equal magnitude and parallel, the shearing edge 103 will travel along the arc 170.

Although not illustrated in FIG. 4, it is within the scope of the present invention to make these parallel arms of a structure that would permit the length of the arms variable to adjust the clearance distance 54 to a predetermined value as required.

It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In combination with a planer apparatus having a planer cutter rotatable about a longitudinal axis, the planer cutter utilized for contacting and cutting away the top portion of a paved roadway, the improvement comprising:

breaker plate means for providing a counteracting shearing force on the top portion of the paved roadway forward of the planer cutter so that the removal of the top portion of the roadway by the planer cutter is effected in the form of cuttings of generally uniform size.

2. In combination with a planer apparatus having a planer cutter rotatable about a longitudinal axis, the planer cutter utilized for contacting and cutting away the top portion of a paved roadway, the improvement comprising:

breaker plate means for providing a counteracting shearing force on the top portion of the roadway forward of the planer cutter so that the removal of the top portion of the roadway by the planer cutter is effected in the form of cuttings of generally uniform size, the breaker plate means comprising: roadway engaging means supported by the planer apparatus having a shearing edge; and bias means supported by the planer apparatus for yieldingly urging the shearing edge into contact with the top portion of the roadway forward of the planer cutter.

3. The apparatus of claim 2 wherein the roadway engaging means is further characterized as comprising:

a rigid breaker plate member supporting the shearing edge forward of the planer cutter and extending parallel with the longitudinal axis of the planer cutter, the shearing edge contacting the top portion of the roadway as the planer apparatus is moved therealong; and positioning means supported by the planer apparatus for supporting the breaker plate member.

4. The apparatus of claim 3 wherein the bias means is characterized as comprising:

a hydraulic ram connected generally between the planer apparatus and the breaker plate member.

5. The apparatus of claim 4 wherein the positioning means is further characterized as positioning the breaker plate member whereby the shearing edge is disposed forward of the planer cutter.

6. The apparatus of claim 5 wherein the positioning means is characterized as comprising:

an arm member connected to the planer apparatus and to the breaker plate member maintaining the shearing edge forward of the planer cutter.

7. A breaker plate apparatus for use with an apparatus having a rotatable planer cutter utilized for removing the top portion of a paved roadway, the breaker plate apparatus comprising:

breaker plate means positioned a distance forward of the rotatable planer cutter for exerting a counter shearing force on the top portion of the paved roadway forward of the planer cutter as the planer cutter is moved in a forward direction in cutting engagement with the paved roadway, the breaker plate means and the rotatable cutter cooperating to effect the sizing of the removed portion of the paved roadway in the form of cuttings of generally uniform size.

8. The apparatus of claim 7 wherein the breaker plate means is characterized as comprising:

a breaker plate member having a shearing edge; and bias means for urging the shearing edge into contact with the top portion of the roadway forward of the planer cutters.

9. The apparatus of claim 8 wherein the breaker plate member is characterized as comprising:

a rigid breaker plate member supporting the shearing edge forward of the planer cutter and extending parallel to the axis of the planer cutter, the shearing edge slidingly contacting the top portion of the roadway as the planer cutter is caused to be moved along the paved roadway; and wherein the breaker plate apparatus further comprises: positioning means for supporting and positioning the breaker plate member.

10. The apparatus of claim 9 wherein the bias means is characterized as comprising:

hydraulic ram means connected to the breaker plate member for urging the shearing edge against the top portion of the roadway.

11. The apparatus of claim 9 wherein the bias means is characterized as comprising:

spring means connected to the breaker plate member for urging the shearing edge against the top portion of the roadway.

12. The apparatus of claim 10 wherein the positioning means is characterized as comprising:

at least one arm member connected to the planer cutter and to the breaker plate member maintaining the shearing edge forward to the planer cutter.

13. In combination with a planer apparatus having a planer cutter rotatable about a longitudinal axis, the planer cutter utilized for removing the top portion of a paved roadway, a breaker plate assembly comprising:

a positioning assembly supported by the planer apparatus; and at least one breaker plate member supported by the positioning assembly parallel to the longitudinal axis forward of the planer cutter to effect the removal of the top portion of the roadway in the form of cuttings of generally uniform size.

14. The breaker plate assembly of claim 13 wherein the breaker plate has a shearing edge and wherein the breaker plate assembly is further characterized as comprising:

bias means connected to the planer apparatus and to the breaker plate member for urging the shearing edge into contact with the top portion of the roadway forward of the planer cutter.

15. The breaker plate assembly of claim 14 wherein the positioning assembly is characterized as comprising:

at least one arm member pivotally connected to the planer apparatus and connected to the breaker plate member.

16. In combination with a planer apparatus having a planer cutter rotatable about a longitudinal axis, the planer cutter utilized for removing the top portion of a paved roadway, a breaker plate assembly comprising:

a positioning assembly supported by the planer apparatus and characterized as comprising a parallelogram linkage assembly supported by the planer apparatus; and at least one breaker plate member supported by the positioning assembly parallel to the longitudinal axis forward of the planer cutter to effect the removal of the top portion of the roadway in the form of cuttings of generally uniform size, the parallelogram linkage assembly connected to the breaker plate member, said breaker plate member having a shearing edge movable along an arc concentric with the longitudinal axis whereby the shearing edge is maintained a constant distance forward of the planer cutter.

17. The breaker plate assembly of claim 16 further characterized as comprising:

bias means connected to the planer apparatus and to the breaker plate member for urging the shearing edge into contact with the top portion of the roadway forward of the planer cutter.

18. The breaker plate assembly of claim 17 wherein the bias means is characterized as comprising:

a hydraulic ram connected to the breaker plate member for urging the shearing edge against the top portion of the roadway.

19. The breaker plate assembly of claim 17 wherein the bias means is characterized as comprising:

a spring connected to the breaker plate member for urging the shearing edge against the top portion of the roadway.

20. In combination with a planer apparatus having a planer cutter rotatable about a longitudinal axis, the planer cutter utilized for removing the top portion of a paved roadway, a breaker plate assembly comprising:

a first parallelogram linkage assembly supported by the planer assembly;

a second parallelogram linkage assembly supported by the planer assembly in spaced apart relationship to the first parallelogram linkage assembly;

a rigid support beam supported by the first and second parallelogram linkage assemblies generally parallel to the longitudinal axis of the planer cutter;

a plurality of rigid breaker plate members connected to the support beam, each breaker plate member having a shearing edge parallel to the longitudinal axis of the planer cutter, the shearing edge of each breaker plate member movable by the pivotation of the first and second parallelogram linkage assemblies along an arc concentric with the longitudinal axis whereby each shearing edge is maintained at a constant clearance distance from the planer cutter; and bias means connected to the planer apparatus and to the support beam for urging the shearing edge into contact with the top portion of the roadway forward of the planer cutter.

21. The breaker plate assembly of claim 20 further characterized as comprising:

a plurality of breaker plate support arms rigidly connected to the support beam and a pair of said support arms supporting each breaker plate member on one portion of the pair of support arms; and variable link means connected to the support beam and to a distil portion of each pair of support arms for varying the shearing edge portions of the breaker plate members to generally conform to the crown cross slope of the roadway.

22. The breaker plate assembly of claim 21 wherein the bias means is characterized as comprising:

at least one hydraulic ram connected to the support beam for urging the shearing edge of each breaker plate member against the top portion of the roadway.

* * * * *

UNITED STATES PATENT AND TRADEMARK OFFICE

CERTIFICATE OF CORRECTION

PATENT NO. : 4,221,434

DATED : September 9, 1980

INVENTOR(S) : George W. Swisher, Jr. and John F. Phillips

It is certified that error appears in the above-identified patent and that said Letters Patent are hereby corrected as shown below:

In the title of the application, the word "PLANAR" should be --PLANER--.

In column 1, line 1, the word "PLANAR" should be --PLANER--.

In column 1, line 10, the word "planar" should be --planer--.

In column 1, lines 13 and 14, the word "planar" should be --planer--.

In column 1, line 18, the word "planar" should be --planer--.

In column 1, line 21, the word "planar" should be --planer--.

In column 1, line 22, the word "planar" should be --planer--.

In column 2, line 56, the word "planar" should be --planer--.

In column 7, line 51 after the word "attached", delete the word "to" and substitute therefor --at--.

UNITED STATES PATENT AND TRADEMARK OFFICE

CERTIFICATE OF CORRECTION

PATENT NO. : 4,221,434

DATED : September 9, 1980

INVENTOR(S) : George W. Swisher, Jr. and John F. Phillips

It is certified that error appears in the above-identified patent and that said Letters Patent are hereby corrected as shown below:

In column 7, line 51, after the word "end" , delete the word "of" and substitute therefor --to--.

In column 7, line 51, after the word "pair", delete the word "to" and substitute therefor --of--.

In column 9, line 67, before the word "roadway", add the word --paved--.

Signed and Sealed this

*Thirtieth* Day of *December 1980*

[SEAL]

*Attest:*

*Attesting Officer*

SIDNEY A. DIAMOND

*Commissioner of Patents and Trademarks*